United States Patent [19]

Gottschall

[11] 4,194,979

[45] Mar. 25, 1980

[54] DRY CHEMICAL FIRE EXTINGUISHING POWDER CONTAINING ALKALI METAL GLUCONATE

[76] Inventor: Harald Gottschall, Hartwigstrasse 16, Schwäbisch Hall-Steinbach, Fed. Rep. of Germany

[21] Appl. No.: 901,016

[22] Filed: Apr. 27, 1978

[30] Foreign Application Priority Data

Jun. 22, 1977 [DE] Fed. Rep. of Germany ..... 2728076

[51] Int. Cl.[2] ..... A67D 1/00

[52] U.S. Cl. ..... 252/7; 252/5

[58] Field of Search ..... 252/5, 7

[56] References Cited

U.S. PATENT DOCUMENTS 3,585,135 6/1971 Smith et al. ..... 252/7

FOREIGN PATENT DOCUMENTS 1302520 10/1970 Fed. Rep. of Germany ..... 252/5

1505541 11/1967 France ..... 252/7

*Primary Examiner*—Leland A. Sebastian

*Attorney, Agent, or Firm*—Frishauf, Holtz, Goodman & Woodward

[57] ABSTRACT

Alkali metal salts, particularly the potassium salt, of gluconic acid or its stereoisomers have been found to be particularly useful as active ingredients of dry chemical fire extinguishers and can be used alone, or with a small amount of flowing agent and hydrophobic agent or in combination with other dry chemical extinguisher powders, such as sodium bicarbonate, ammonium phosphate and ammonium sulfates. These gluconates are stable, non-hygroscopic and have a high flame extinguishing effect.

8 Claims, No Drawings

DRY CHEMICAL FIRE EXTINGUISHING POWDER CONTAINING ALKALI METAL GLUCONATE

This invention concerns dry chemical fire extinguisher powder and particularly of a kind using alkali metal salts of organic acids.

Salts of sodium or, even better, of potassium, are already known as compounds effective in fire extinguishing. Among the salts, some are more and others less effective as extinguishers (the subject was reviewed in VFDB Zeitschrift "Forschung und Technik im Brandschutz", volume 9, special issue 2, Jan. 1960).

Potassium compounds have a higher extinguishing effectiveness compared to sodium compounds, as for example in the case of potassium bicarbonate. The stability of potassium compounds, however, because of their hygroscopic tendency and their increased readiness for dissociation is much less than the range of stability of the corresponding sodium compounds.

Potassium bicarbonate, therefore, on account of its instability and its tendency to agglomerate into lumps is rarely used as an ingredient in an extinguishing powder, and when it is used, the widely normal 2-year extinguisher test interval is shortened by ½ year, as has occurred for example in the United States.

In Swiss Pat. No. 196,483 and also "Das chemsiche Feuerlöschwesen" by Kausch, potassium bitartrate is described and disclosed as a notable, very stable extinguishing powder component of good effectiveness. Its high price is a drawback for its use in such composition (see German published patent application (OS) No. 25 34 949) as is also the constantly diminishing amount of the deliveries of this natural product from wine cellars resulting from the substitution of stainless tanks for for the previously used casks.

In German published patent application (OS) No. 1 302 520 the potassium salt of citric acid is claimed as a component of an extinguisher composition. The high price and the partly occurring hygroscropic properties here again led to difficulties in the adoption of this material.

The requirements that are set today for a good extinguishing material are the following: An extinguishing material in powder form should be stable and should not decompose at high temperature, it should not be toxicologically or physiologically harmful, it should not have any hygroscopic properties, there should be a reasonable relation between its price and its extinguishing effectiveness, it should be easily producible technically in unlimited quantities and it should be capable of being used mixed with other extinguisher ingredients, as for example phosphates and sulfates, without reacting with these materials.

It has been unexpectedly discovered that the alkali metal salts of gluconic acid have properties that fulfill these requirements, a property that appears to be shared with the alkali salts of the stereoisomers of gluconic acid.

The alkali metal salts of gluconic acid are entirely nontoxic and physiologically harmless in their use, have good extinguishing effectiveness, are not hygroscopic and are available in unlimited quantity.

Gluconic acid is produced from dextrose by mild oxidation and the hydrogen atom of its carboxyl group is readily replaced by an alkali metal:

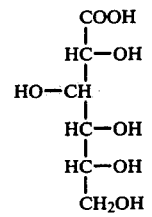

Gluconic acid begins to decompose only at 200° C. and is widely used in industry, for example as an agent for dissolving lactic deposits, for developing vat dyeing esters, loading materials for silks, manufacture of sizing, as an additive for soft drinks and similar applications. Sodium gluconate is also used in the dairy, brewery, fruit juice and soft drink industries.

In the making of alcoholic beverages immense quantities of dextrose or grape sugar, respectively, are converted to alcohol. Dextrose is a pure and inexhaustible raw material for the production of gluconic acid.

The dry chemical fire extinguishing powder according to the invention having a base of alkali metal salts of gluconic acids or its isomers of similar structural formulas is distinguished by the fact that the powder contains, as an active ingredient a salt of gluconic acid or of a stereoisomer thereof, in which the hydrogen atom of the carboxyl group has been replaced by lithium, sodium, potassium, rubidium or cesium and it may contain, in addition to active ingredients an incidental inert material, known hydrophobic agents and flowing agents (fluxes).

Although the salts of the gluconic acid are preferred due to their ready accessibility, also stereoisomers thereof, such as talonic acid and mannonic acid may be used. Though, the naturally occuring L-form of the gluconic acid is preferred due to its ready availability, also the D-form thereof or the D,L-forms or the D-form of the further stereoisomeric gluconic acids may be used with the same success.

Potassium gluconate is particularly advantageous to use. The dry chemical fire extinguishing powder of the invention can usefully contain also a portion consisting of previously known extinguishing agents, such as ammonium phosphate and/or sulfate and/or chloride and/or sodium compounds.

In the case of ABC dry chemical extinguisher powders of an ammonium phosphate and sulfate base the presence of potassium gluconate as an ingredient produces additionally, for increased flame extinction, by caramelization of the gluconic acid (glucose), a good covering for the embers and their hidden warmth centers in the core of the fire.

The extinguishing effect of the known BCE dry chemical extinguisher powders based on sodium bicarbonate can, for example, be substantially improved by addition of potassium gluconate.

The following examples further illustrate the invention. The numerical parts listed in the given examples are by weight. The supply source for the material is given in brackets in the first example.

EXAMPLE 1

88.75 parts potassium gluconate (Benckisser)
10.00 parts barium sulfate RC 14 (Sachtleben)
0.50 parts silicone oil (Goldschmidt)
0.75 parts aerosil R 972 (Degussa)

EXAMPLE 2

39.0 parts ammonium phosphate
39.0 parts ammonium sulfate
10.0 parts barium sulfate RC 14
10.5 parts potassium gluconate
0.3 parts silicone oil
1.2 parts aerosil R 972

EXAMPLE 3

88.0 parts of sodium bicarbonate
10.0 parts potassium gluconate
2.0 parts lubricant and material applying hydrophobic qualities.

For tests in practice the compositions mentioned in the preceding examples 1 to 3 were thoroughly mixed in a conventional mixer, such as a Henschel mixer or a V-mixer. The powder mixer obtained was fed into the respective container of a conventional dry extinguisher.

With fire extinguishing tests according to the usual prescriptions it was shown that with these compositions according to examples 1 to 3 extinguishing results were obtained by far superior to those obtained with the same compositions, which, however, did not contain gluconate salt.

When an alkali metal gluconate, and especially potassium gluconate, is used as substantially the only active ingredient, it should constitute 5 to 20% by weight, especially 8 to 15% by weight of the powder with regard to the kind of effectiveness that the modern purchaser has a right to expect. Where other extinguishing agents are used along with it, even small quantities, as little as 3% by weight will provide an improvement.

The mixing of the ingredients involves no departure from present methods and it is convenient to bring the ingredients together in a powder state and mix them in conventional mixing machinery.

I claim:

1. A dry chemical fire extinguishing powder comprising as an active ingredient thereof a significant content of a substance selected from the group consisting of alkali salts of gluconic acid and its stereoisomers, the remainder, if any, of said powder, other than active ingredients and inert materials, consisting of at least one material selected from the group consisting of flowing agents and hydrophobic agents.

2. A dry chemical fire extinguishing powder as defined in claim 1, in which said content of one or more alkali salts of one or more organic acids selected from the group consisting of gluconic acid and its stereoisomers constitutes the principal active ingredient of said powder and forms at least 5% by weight thereof.

3. A dry chemical fire extinguishing powder as defined in claim 1, in which said content of alkali salt of one or more organic acids selected from the group consisting of gluconic acid and its stereoisomers consists essentially of potassium gluconate.

4. A dry chemical fire extinguishing powder as defined in claim 2, in which said content of alkali salt of one or more organic acids selected from the group consisting of gluconic acid and its stereoisomers consists essentially of potassium gluconate.

5. A dry chemical fire extinguishing powder as defined in claim 1, containing also as active ingredient one or more substances selected from the group consisting of ammonium phosphate, ammonium sulfate, ammonium chloride, sodium carbonate and sodium bicarbonate.

6. A dry chemical fire extinguishing powder as defined in claim 2, containing also as active ingredient one or more substances selected from the group consisting of ammonium phosphate, ammonium sulfate, ammonium chloride, sodium carbonate and sodium bicarbonate.

7. A dry chemical fire extinguishing powder as defined in claim 3, containing also as active ingredient one or more substances selected from the group consisting of ammonium phosphate, ammonium sulfate, ammonium chloride, sodium carbonate and sodium bicarbonate.

8. A dry chemical fire extinguisher powder as defined in claim 4, containing also as active ingredient one or more substances selected from the group consisting of ammonium phosphate, ammonium sulfate, ammonium chloride, sodium carbonate and sodium bicarbonate.

* * * * *